United States Patent [19]

Takagi et al.

[11] 4,275,862

[45] Jun. 30, 1981

[54] WALL HANGING HOLDER FOR ELECTRIC SHAVER

[75] Inventors: Takeshi Takagi, Kadoma; Tokushi Abo, Ashiya, both of Japan

[73] Assignee: Matsushita Electric Works, Ltd., Osaka, Japan

[21] Appl. No.: 55,072

[22] Filed: Jul. 5, 1979

[30] Foreign Application Priority Data

Jul. 4, 1978 [JP] Japan ..... 53-81776

[51] Int. Cl.[3] ..... F16M 13/00

[52] U.S. Cl. ..... 248/205 A; 248/309 R

[58] Field of Search ..... 248/111, 205 A, 309 R, 248/311.2, 312, 314

[56] References Cited

U.S. PATENT DOCUMENTS

| | | | |
|---|---|---|---|
| 2,616,647 | 11/1952 | Murchison | 248/312 X |
| 2,662,719 | 12/1953 | Hammond | 248/314 |
| 3,178,138 | 4/1965 | Hessdoerfer et al. | 248/205 A X |
| 3,367,610 | 2/1968 | Lindquist | 248/205 A X |
| 3,532,310 | 10/1970 | Finfrock | 248/300 X |
| 4,088,848 | 5/1978 | Weed | 248/309 R X |

FOREIGN PATENT DOCUMENTS

| | | | |
|---|---|---|---|
| 1486895 | 9/1977 | United Kingdom | 248/312 |

*Primary Examiner*—William H. Schultz

*Attorney, Agent, or Firm*—Burns, Doane, Swecker & Mathis

[57] ABSTRACT

A foldable wall hanging holder for electric shaver comprises an integral plate of a synthetic resin which is foldably or bendably divided into fixing, holding and bracing plate parts respectively by means of first and second hinge parts. The respective plate parts are bent at the hinge parts to form a right-angled triangle, with the holding plate part braced by the bracing plate part at right angles with respect to the fixing plate part to be fixed to a wall surface or the like, for holding the shaver in a hole of the holding part and in an aperture of the bracing plate part aligned with the hole.

8 Claims, 5 Drawing Figures

WALL HANGING HOLDER FOR ELECTRIC SHAVER

This invention relates generally to wall hanging holders for electric shavers and, more particularly, to improvements in holders for stably holding electric shavers as hung on a wall surface or the like and yet in a manner ready to use.

Generally, the electric shaver is daily frequently used but, when it is not used, it is normally stored in a container box or placed as it is on a shelf on a bath room wall or within a cabinet. It is rather troublesome to take out the shaver stored in the container to use it especially when the user is in a hurry and, when the shaver is placed simply on the shelf, a risk of dropping the shaver on the floor is involved. In view of such circumstances, there have been suggested holders which are fixed to a wall surface for stably holding the shaver in a manner allowing ready hanging and taking. However, the suggested holders are formed from the beginning to comprise mainly a vertical part to be fixed to the wall surface or the like and a horizontal part extending transversly from the vertical part to hold the shaver and they are not foldable. Therefore, such holders are bulky, requiring an excessive space, and inconvenient specifically when each of them is packed up alone or together with the shaver. The present invention has been suggested to remove such defects of the conventional holders of the kind referred to.

A primary object of the present invention is, therefore, to provide a foldable wall hanging holder for electric shavers which is simple to be set into the form for use and to be fixed to a wall or the like and yet is capable of reliably stably holding the shaver.

Another object of the present invention is to provide a wall hanging holder for electric shavers which can be packed compactly and thus advantageously transported.

Another related object of the present invention is to provide a wall hanging holder for electric shavers wherein thin connecting hinge parts in a foldable plate-shaped structure can be protected from being damaged due to a fatigue.

Other objects and advantages of the present invention will become clear from the following descriptions thereof detailed with reference to a preferred embodiment of the invention as shown in accompanying drawings, in which.

Figure 1:
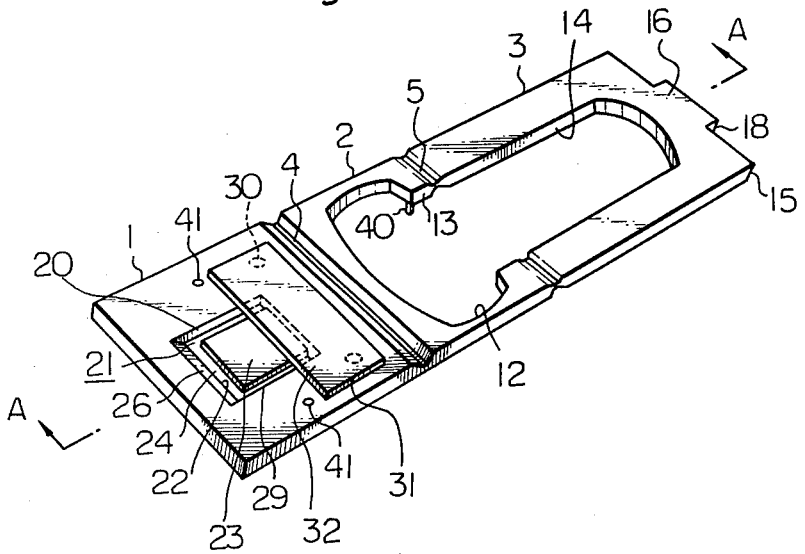
FIG. 1 is a perspective view as developed of an embodiment of a foldable wall hanging holder for electric shavers according to the present invention formed in an integral plate shape.

Referring to the drawings, a foldable wall hanging holder for electric shavers of an embodiment of the present invention, which comprises a fixing plate part 1, holding plate part 2 and bracing plate part 3, is molded with a synthetic resin having a proper elasticity into such integral plate-shaped body as shown in FIG. 1.

Figure 2:
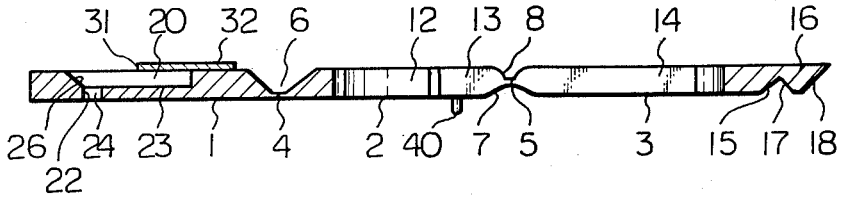
FIG. 2 is a sectioned view also as developed of the holder taken along line A—A in FIG. 1.

That is, this plate-shaped body is divided in the lengthwise direction into three parts by means of first and second hinges 4 and 5 respectively formed to be a thin part extending over the entire length in the transverse width direction of the plate-shaped body. As illustrated in FIG. 2, the first hinge 4 is formed to be thin by incising a linear part on one surface of the plate-shaped body to be V-shaped groove 6, and the holding plate part 2 connected through the first hinge 4 to the fixing plate part 1 can be bent at the hinge 4 on the side opposite the V-shaped groove 6 in the present instance. The second hinge 5 is also provided by making another linear part thin with incisions on both sides at 7 and 8 of the plate-shaped body forming respectively a substantially V-shaped groove. Preferably, as seen in FIG. 2, incision width of the V-shaped groove 7 on the side opposite the groove 6 of the first hinge in the present instance is made larger than that of the groove 8 on the other side so that the bracing plate part 3 can be bent by an angle larger than the right angle from the position of the alignment with the holding plate part as in FIG. 1 or 2 to the position shown in FIG. 3 on the side of the groove 7.

Figure 3:
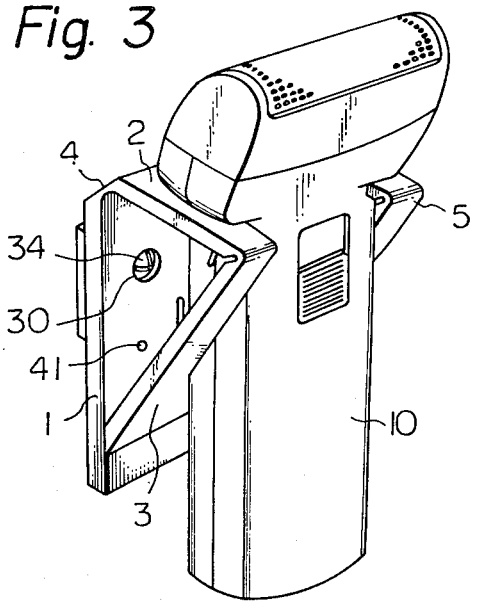
FIG. 3 is a perspective view of the holder of FIG. 1 as assembled and fixed to a wall surface or the like so as to be used to hold an electric shaver.

In case the holder of the present invention is to hold, for example, such electric shaver 10 of reciprocally driven blade type as seen in FIG. 3, the shaver 10 will be wide in its shaving head part but narrower in elongated body part providing stepped parts below the head part. Therefore, the holding plate part 2 of the holder is provided with an engaging hole 2 having substantially the same shape and size as of a sectional shape at the body part immediate below the stepped parts of the shaver so that the head part of the shaver 10 will ride on the holding plate part 2 while the body part is passed through the engaging hole 12. In the bracing plate part 3, there is provided a window or aperture 14 having a width substantially equal to that of the body part of the shaver and extending in the longitudinal direction of the plate part 3. Therefore, when the holding and bracing plate parts 2 and 3 are respectively bent at the hinges 4 and 5 to form a right-angled triangle with respect to the fixing plate part 1, to set the holder in its state of using, as shown in FIG. 3, the engaging hole 12 and aperture 14 will align with each other in the direction substantially parallel to the fixing plate part 1 so as to allow the body part of the shaver 10 to be enclosed in such aligned hole 12 and aperture 14.

In the illustrated case of the embodiment, as a most preferable arrangement, the hole 12 and aperture 14 are mutually communicated or continuous through the second hinge 5 where partly cut to provide an entrance 13 which is opened toward the user in the set state of the right-angled triangle as seen in FIG. 3.

Tip end of the bracing plate part 3 is made to be a sloped surface 15 diagonally inclined toward the side of the V-shaped groove 7 of the second hinge 5 so that, when the plate part 3 is bent and the sloped surface 15 is engaged with the surface of the fixing plate part 1, the plate part 3 will be positioned at an acute angle with respect to the fixing plate part 1. In order to secure the bracing plate part 3 in this position, an inserting pawl 16 is preferably provided at the sloped tip end surface 15 of the plate part 3 so as to extend in the longitudinal direction of and in flush with the plate part 3 substantially at the central section in the width direction of the sloped tip end surface 15. This inserting pawl 16 has a groove 17 made on the same side with the groove 7 to have a surface flush with the sloped tip end surface 15 and extended end surface 18 of the pawl 16 is also sloped in the same manner as the sloped surface 15.

Figure 5:
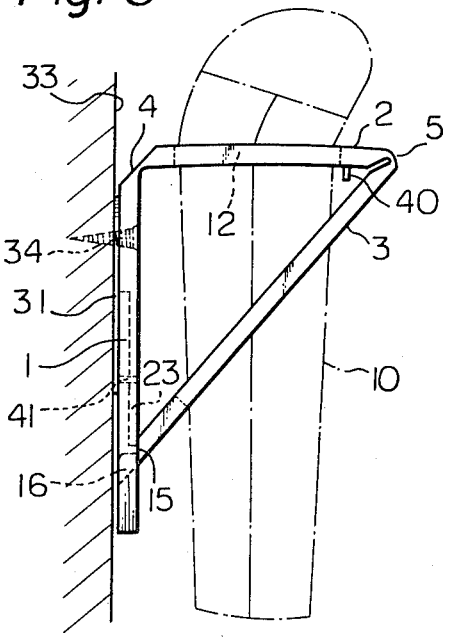
FIG. 5 is a side elevation of the holder of FIG. 1 in the similar state to FIG. 3 of being used.

The fixing plate part 1 of the holder is provided with a rectangular recess 20 made substantially in the central area on the same side as the V-shaped groove 6, that is, on the side to be butted against the wall surface. A substantially U-shaped through hole 21 is provided in the recess 20 along the peripheries thereof except one on the side of the first hinge 4. A part 22 of this U-shaped hole 21 on the side opposite the hinge 4 is made to have substantially the same width as or slightly larger than that of the inserting pawl 16. Thus, a fin 23 of a smaller thickness and extending from the side of the first hinge 4 toward the other side end of the plate part 1 is formed within the recess 20 as defined by the U-shaped through hole 21, and the part 22 of the hole 21 forms an engaging slot 24 for the pawl 16 of the bracing plate part 3. When the bracing plate part 3 is bent in the manner described before and the pawl 16 is inserted into this engaging slot 24, the surface of the pawl 16 on the side of the groove 8 of the second hinge 5 and exposed outside is brought into contact with a diagonal edge part 26 formed in the fixing plate part 1 along the part 22 of the through hole 21 as seen in FIG. 1. Here, the fin 23 of the smaller thickness and cantilevered is given a resiliency by the elasticity of the synthetic resin so that, in the case when the pawl 16 is inserted into the engaging slot 24, the sloped end 18 of the pawl 16 will cause the fin 23 to resiliently bend at its free end while advancing into the engaging slot 24 as guided at both sides of the pawl 16 by both side edges 29 of the through hole 21. When the pawl 16 further advances along the diagonal edge part 26 of the hole 21 and the groove 17 of the pawl 16 reaches the free end of the fin 23, it is caused that the fin 23 so far being bent is returned to the original state due to its elastic returning force, and the fin's free end will elastically engage in the groove 17 to abut its surface flush with the sloped tip end surface 15 of the bracing plate part 3, whereby the pawl 16 is pressed against the diagonal edge part 26 of the engaging slot 24 of the fixing plate part 1 and the bracing plate part 3 is locked in its bent and set position, as seen in FIG. 5. In the position, the sloped tip end surface 15 rests flatly on opposing surface of the plate part 1. The pawl 16 is preferably made to be of a length that terminates on the plane of the other surface of the plate part 1 to oppose the wall surface or a length shorter than that. It may be possible, for a simpler structure, to provide a projection or recess on the surface of the plate part 1 for engaging thereto the tip end of the bracing plate part 3, but the arrangement as referred to above is most preferable for keeping the surface of the fixing plate part 1 substantially flat and achieving a reliable locking of the bracing plate part 3.

Further, the fixing plate part 1 has through holes 30 for passing screws to fasten the holder against a wall surface 33 or the like, respectively made in each side of the recess 20, and an adhesive layer 31 covered with a peelable paper sheet 32 at least on a part of the surface having the recess 20. In fixing the holder to the wall surface 33, therefore, the paper 32 is peeled off and the fixing plate part 1 is adhered to a desired position of the wall surface 33 by means of the adhesive layer 31. If it is necessary or desired to more strongly fix, the screws 34 may be screwed into the wall surface 33 through the respective holes 30.

Figure 4:
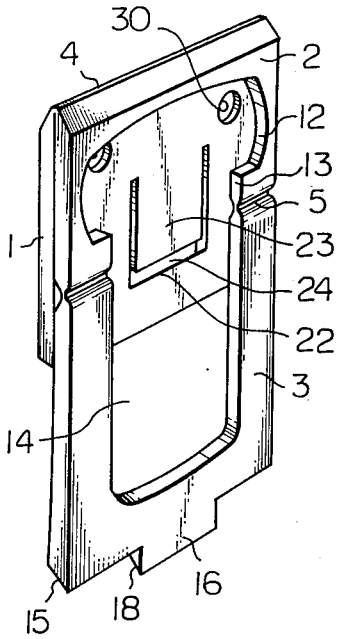
FIG. 4 is a perspective view of the holder of FIG. 1 as partly folded into a preferable state for packing.

The holding plate part 2 is provided with a pair of projections 40 on the side of the V-shaped groove 7 of the second hinge, and the fixing plate part 1 is provided with fitting holes 41 into which the respective projections 40 can be removably fitted at positions symmetrical with positions of these projections 40 with respect to the first hinge 4. Therefore, the integral plate-shaped holder of the present invention can be held folded, while the projections 40 are fitted into the respective fitting holes 41, with the holding plate part 2 overlapped on the fixing plate part 1 as shown in FIG. 4. That is, while the holder according to the present invention is formed in an integral plate-shape and is possibly larger in the total length than that of the shaver to be used with this holder, the holder can be folded at least at the first hinge 4 so that the holding plate part 2 and bracing plate part 3 mutually kept extended and aligned with each other can be flatly overlapped on the fixing plate part 1, whereby the holder is kept compact and small in the length. Therefore, even if the holder is packed within a packing case together with the shaver, it will not be necessary to enlarge the dimensions of said packing case.

In the embodiment shown, the second hinge 5 is formed of the grooves 7 and 8 provided on both surfaces of the plate-shaped body of the holder. It may be possible to form this hinge only with the groove 7 provided as deep as the groove 6, omitting the groove 8, so that, in the state of FIG. 4, the bracing plate part 3 may be further folded at the second hinge 5 over the holding plate part 2 to further reduce the length for the packing. In this case, on the other hand, the bracing plate part 3 must be turned back by an angle over 180 degrees in order to be in the position shown in FIG. 3 or 5 in order to set up the holder and the material will be likely to be fatigued due to repeated expansion and contraction in the hinge part during such folding and turning back. In the preferable embodiment shown, therefore, the groove 8 is provided also on the side opposite the groove 7 so that such bending by more than 180 degrees may be made impossible, and the folded form shown in FIG. 4 will be made 9 preferable state for the packing, whereby the fatigue can be prevented from being caused by the repeated bending of the hinge 5.

In the first hinge 4, as different from the case of the second hinge, the turning back from the state of FIG. 4 to the state of FIG. 5 for the fixing is retained to be within a range of about 90 degrees and the fatigue of the material will be kept minimum. It is of course possible to bend the plate-shaped body of the holder by about 90 degrees at each of the first and second hinges so as to be substantially U-shape and to pack the shaver as contained in the thus made space in the U-shape of the holder, in which case the fatigue at the first hinge 4 may be entirely avoided and that at the second hinge 5 kept minimum.

In order to hang the electric shaver 10 on the holder according to the present invention fixed to the wall or the like as described above, the barrel part of the shaver with its shaving head directed upward is inserted into the engaging hole 12 and aperture 14 through the entrance 13 of the second hinge 5 which projecting from the wall surface and the shaving head of the shaver is placed on the holding plate part 2 which lying substantially at right angles with respect to the wall surface. While, as described above, the illustrated embodiment has the engaging hole 12 fitted to the contour of the shaver of the reciprocally driven blade type, the engaging hole is not limited to be of such shape but can be of any shape adapted to other type of electric shaver. In case the electric shaver does not have such neck part as in the illustrated case, a proper neck part may be provided in such shaver, so that the holder of the present invention can be readily used with shavers of various types.

What is claimed is:

1. A wall hanging holder for electric shaver substantially comprising a fixing plate part for fixing on its one surface said holder to a wall surface or the like, a holding plate part having a hole for holding the shaver, and a bracing plate part for bracing said holding plate part in its position for holding the shaver, said fixing, holding and bracing plate parts being formed with a synthetic resin material into an integral plate in which a first hinge part connects an end of the fixing plate part to an end of the holding plate part foldably in longitudinal direction of said integral plate and a second hinge part connects also foldably the other end of the holding plate part to an end of the bracing plate part so that when the integral plate is bent at said first and second hinge parts the respective plate parts form a right-angled triangle with the holding plate part braced at right angles with respect to the fixing plate part by the bracing plate part, said fixing plate part having means for securing the other end of the bracing plate part at its position of said right-angled triangle, and said bracing plate part having an aperture for enclosing therein a body part of the shaver extending from a shaving head part of the shaver placed above the holding plate part as held in said holding hole thereof.

2. The holder as claimed in claim 1 wherein said hole of the holding plate part and said aperture of the bracing plate part are mutually communicated through said second hinge part so that an entrance is provided at the hinge part for passing said body part of the shaver into the hole and aperture when the holder is set in said right-angled triangle.

3. The holder as claimed in claim 1 wherein said first hinge part is formed with a groove made in width direction of said integral plate on the same side thereof as said fixing surface of said fixing plate part, and said second hinge is formed with opposing grooves respectively made in said width direction on each side of the integral plate.

4. The holder as claimed in claim 3 wherein said holding plate part has projections on the other side of the plate part than that of said groove forming said first hinge part, and said fixing plate part has engaging holes at positions symmetrical with said projections with respect to the first hinge part for detachably engaging therein the projections when the holding plate part is folded over said fixing plate part.

5. The holder as claimed in claim 1 wherein said fixing plate part has an adhesive layer covered with a peelable paper on said fixing surface.

6. The holder as claimed in claim 5 wherein said fixing plate part further has through holes for passing therethrough screws to fasten the holder against said wall surface.

7. The holder as claimed in claim 1 wherein said securing means comprises a slot made in said fixing plate part, and said bracing plate part has at said the other end an extended pawl to be engaged in said slot when the holding and bracing plate parts are bent to form said right-angled triangle with the fixing plate part.

8. The holder as claimed in claim 7 wherein said fixing plate part is further provided with a resilient fin a free end of which defining an edge of said slot on the side of said first hinge part, and said pawl of said bracing plate part has a groove on the side opposing the fixing plate part so that said free end of said fin engages in said groove of the bracing plate part when the bracing plate part is bent and the pawl is engaged in the slot and urges the pawl against the other edge of the slot.

* * * * *